US006943763B2

(12) United States Patent
Shibata et al.

(10) Patent No.: US 6,943,763 B2
(45) Date of Patent: Sep. 13, 2005

(54) LIQUID CRYSTAL DISPLAY DEVICE AND DRIVE CIRCUIT DEVICE FOR

(75) Inventors: Susumu Shibata, Kikuchi-gun (JP); Shiro Miyake, Kikuchi-gun (JP)

(73) Assignee: Advanced Display Inc., Kikuchi-gun (JP)

( * ) Notice: Subject to any disclaimer, the term of this patent is extended or adjusted under 35 U.S.C. 154(b) by 687 days.

(21) Appl. No.: 09/942,542

(22) Filed: Aug. 31, 2001

(65) Prior Publication Data

US 2002/0030652 A1 Mar. 14, 2002

(30) Foreign Application Priority Data

Sep. 13, 2000 (JP) ..... 2000-278766

(51) Int. Cl.[7] ..... G09G 3/36
(52) U.S. Cl. ..... 345/89; 345/98; 345/690
(58) Field of Search ..... 345/87–100, 690, 345/204

(56) References Cited

U.S. PATENT DOCUMENTS 5,434,957 A * 7/1995 Moller ..... 345/593
2001/0038372 A1 * 11/2001 Lee ..... 345/89

FOREIGN PATENT DOCUMENTS

| | | |
|---|---|---|
| JP | 5-183743 | 7/1993 |
| JP | 5-336376 | 12/1993 |
| JP | 6-189232 | 7/1994 |
| JP | 10-143111 | 5/1998 |
| JP | 11-338424 | 12/1999 |

* cited by examiner

*Primary Examiner*—Regina Liang
(74) *Attorney, Agent, or Firm*—Oblon, Spivak, McClelland, Maier & Neustadt, P.C.

(57) ABSTRACT

A liquid crystal display device is provided with a image data inputting means for inputting image data and a image data memory for storing image data comprising a number of bits which is fewer than the number of bits in the image data input to the image data inputting means, on the basis of this image data. In addition, a liquid crystal display device is provided with corrected data generating means for generating corrected data by correcting the current image data input to the image data inputting means, on the basis of previous image data stored in the image data memory. Consequently, the liquid crystal display device enables the capacity of image data memory for storing previous image data to be reduced, thereby yielding a merit in that cost savings can be achieved.

18 Claims, 10 Drawing Sheets

| | Frame Memory Capacity(bit) | Look-up Table Capacity (bit) | No. of Bus Lines |
|---|---|---|---|
| 8bit Processing (Prior Art) | 18M | 1.5M | 24 |
| 7bit Processing | 15.75M | 768k | 21 |
| 6bit Processing | 13.5M | 384k | 18 |
| 5bit Processing | 11.25M | 192k | 15 |
| 4bit Processing | 9M | 96k | 12 |
| 3bit Processing | 6.75M | 48k | 9 |
| 2bit Processing | 4.5M | 24k | 6 |

FIG.6

| | Frame Memory Capacity(bit) | Look-up Table Capacity (bit) | No. of Bus Lines |
|---|---|---|---|
| 8bit Processing (Prior Art) | 18M | 1.5M | 24 |
| 7bit Processing | 15.75M | 672k | 21 |
| 6bit Processing | 13.5M | 288k | 18 |
| 5bit Processing | 11.25M | 120k | 15 |
| 4bit Processing | 9M | 48k | 12 |
| 3bit Processing | 6.75M | 18k | 9 |
| 2bit Processing | 4.5M | 6k | 6 |

FIG.8

| | Frame Memory Capacity(bit) | Look-up Table Capacity (bit) | No. of Bus Lines |
|---|---|---|---|
| 8bit Processing (Prior Art) | 18M | 1.5M | 24 |
| 7bit Processing | 15.75M | 336k | 21 |
| 6bit Processing | 13.5M | 72k | 18 |
| 5bit Processing | 11.25M | 15k | 15 |
| 4bit Processing | 9M | 3k | 12 |
| 3bit Processing | 6.75M | 576 | 9 |
| 2bit Processing | 4.5M | 96 | 6 |

FIG.9

| | Look-up Table Capacity (bit) | No. of Bus Lines |
|---|---|---|
| 24bit Processing (Prior Art) | 18M | 24 |
| 23bit Processing | 17.25M | 23 |
| 22bit Processing | 16.5M | 22 |
| 21bit Processing | 15.75M | 21 |
| 20bit Processing | 15M | 20 |
| 19bit Processing | 14.25M | 19 |
| 18bit Processing | 13.5M | 18 |
| 17bit Processing | 12.75M | 17 |
| 16bit Processing | 12M | 16 |
| 15bit Processing | 11.25M | 15 |
| 14bit Processing | 10.5M | 14 |
| 13bit Processing | 9.75M | 13 |
| 12bit Processing | 9M | 12 |
| 11bit Processing | 8.25M | 11 |
| 10bit Processing | 7.5M | 10 |
| 9bit Processing | 6.75M | 9 |
| 8bit Processing | 6M | 8 |
| 7bit Processing | 5.25M | 7 |
| 6bit Processing | 4.5M | 6 |

FIG.13

| | Look-up Table Capacity (bit) | No. of Bus Lines |
|---|---|---|
| 8,8,8bit Processing (Prior Art) | 1.5M | 24 |
| 8,8,7bit Processing | 1.25M | 23 |
| 8,7,7bit Processing | 1M | 22 |
| 7,7,7bit Processing | 768M | 21 |
| 7,7,6bit Processing | 625M | 20 |
| 7,6,6bit Processing | 500M | 19 |
| 6,6,6bit Processing | 384M | 18 |
| 6,6,5bit Processing | 320M | 17 |
| 6,5,5bit Processing | 256M | 16 |
| 5,5,5bit Processing | 192M | 15 |
| 5,5,4bit Processing | 160M | 14 |
| 5,4,4bit Processing | 128M | 13 |
| 4,4,4bit Processing | 96M | 12 |
| 4,4,3bit Processing | 80M | 11 |
| 4,3,3bit Processing | 64M | 10 |
| 3,3,3bit Processing | 48M | 9 |
| 3,3,2bit Processing | 40M | 8 |
| 3,2,2bit Processing | 32M | 7 |
| 2,2,2bit Processing | 24M | 6 |

FIG.14

LIQUID CRYSTAL DISPLAY DEVICE AND DRIVE CIRCUIT DEVICE FOR

BACKGROUND OF THE INVENTION

1. Field of the Invention

The present invention relates to a liquid crystal display device, and more particularly, to a liquid crystal display device for comparing current image data with past image data, generating corrected data, and driving liquid crystals by means of the corrected data.

2. Description of the Related Art

In a standard active matrix type liquid crystal display device, the scanning period for one screen image (one frame) is between approximately 50 Hz and 75 Hz. On the other hand, the optical response of liquid crystal molecules requires several 10 ms. Therefore, if a moving image, such as a TV image, is displayed on a liquid crystal display device, then the liquid crystal response cannot follow the changes in the display data of the liquid crystal display device, thereby leading to the problem of latent images.

One of the conventional methods implemented in order to resolve the problem of latent images of this kind is methods which concentrates on the dependence of the response speed of the liquid crystal molecules on the voltage applied thereto. FIG. 16 shows a schematic diagram of the relationship between the liquid crystal applied voltage and liquid crystal response (luminosity change). The diagram shows the case of a liquid crystal display device in "normally white mode" which provides a white display when no voltage is applied. The vertical axis of the graph shows liquid crystal applied voltage and luminosity, and the horizontal axis shows time. In this example, the luminosity change when the liquid crystal applied voltage change is Vx is taken as Bx, and the luminosity change when the liquid crystal voltage change is Vy is taken as By. Furthermore, before timing t1, the previous image data, being the image data for the previous frame, is indicated, and after timing t1, the current image data, being the image data that is currently to be displayed, is indicated.

In this diagram, if the change in the liquid crystal applied voltage is Vx, then in accordance with the change in voltage from the voltage corresponding to the previous image data to the voltage corresponding to the current image data, on either side of timing t1, the luminosity change Bx reaches a prescribed luminosity at timing t2. If, on the other hand, the change in liquid crystal applied voltage is Vy, then in accordance with the change in voltage from the voltage corresponding to the previous image data to the voltage corresponding to the current image data, at timing t1, the luminosity change By reaches a prescribed luminosity at timing t3. As shown in the diagrams, the time period from timing t1 to timing t3 is longer than the time period from timing t1 to timing t2, and hence the larger change in the liquid crystal applied voltage, Vx, causes the prescribed luminosity to be reached more quickly than the voltage change Vy. Accordingly, it can be seen that the time period from the start of response by the liquid crystal until completion of that response, induced by a change in the liquid crystal applied voltage, is quicker, the greater the amount of change in the liquid crystal applied voltage. In other words, the liquid crystal response between black and white is faster than the liquid crystal response between intermediate tones.

Next, a method for improving the response of liquid crystals between intermediate tones is described. FIG. 17 is a schematic diagram of the relationship between the liquid crystal applied voltage and the liquid crystal response (luminosity change). As shown in this diagram, when changing from a dark intermediate tone to a lighter intermediate tone, a lower voltage than the steady electric potential after the change is applied temporarily, thereby speeding up the optical response of the liquid crystals. In this example, the normal change in liquid crystal applied voltage is taken as Vy, and the change in liquid crystal applied voltage according to this improvement method is taken as Vz. The luminosity change in the case of a liquid crystal applied voltage change of Vy is taken as By, and the luminosity change in the case of a liquid crystal applied voltage change of Vz is taken as Bz. Moreover, the period before timing t1 indicates previous image data and the period after timing t1 indicates current image data.

In the diagram, if the change in the liquid crystal applied voltage is Vy, then in accordance with a voltage change at timing t1 from the voltage corresponding to the previous image data to the voltage corresponding to the current image data, the luminosity change By reaches a prescribed luminosity at timing t31. If, on the other hand, the change in the liquid crystal applied voltage is Vz, then in accordance with a voltage change at timing t1 from the voltage corresponding to the previous image data to the voltage corresponding to the current image data, the luminosity change Bz reaches the prescribed luminosity at timing t32. As shown in the diagram, the time period from timing t1 until timing t32 is shorter than the time period from timing t1 to timing t31, and hence a prescribed luminosity can be reached more quickly by adopting the voltage application method according to this improvement method.

If changing from a lighter intermediate tone to a darker intermediate tone, then the optical response of the liquid crystal is speeded up by temporarily applying a higher voltage than the steady electric potential after change. By correcting the liquid crystal applied voltage in this way, it is possible to improve the liquid crystal response characteristics between intermediate tones.

Japanese Patent No. 2,616,652 discloses a liquid crystal drive method and liquid crystal display device whereby, in order to correct the liquid crystal applied voltage corresponding to the current image data, from the relationship between the current image data and the image data for the previous frame, in this aforementioned manner, the data for the previous frame is stored, and the liquid crystal applied voltage is determined by comparing this stored data with the current image data. A concrete composition of a liquid crystal display device applying a method for improving liquid crystal response between intermediate tones, as disclosed in the aforementioned patent, is described below with reference to the drawings. In the example in FIG. 18, the resolution is XGA(1024×3×768), and only the portion of the 256-colour display liquid crystal display device which relates to signal processing is illustrated. In FIG. 18, 1 denotes a timing controller, 2 denotes a frame memory for inputting and storing image data 12 from the timing controller, and 3 denotes data comparing and corrected data generating means, for inputting the current image data 14 from the timing controller 1, inputting the previous image data 13 from the frame memory 2, comparing the two sets of data, and generating corrected data. 4 denotes a signal line driving circuit for driving the signal lines of a liquid crystal panel 6, on the basis of the corrected data and a control signal 16 output by the data comparing and corrected data generating means 3. 5 denotes a scanning line driving circuit for driving scanning lines of the liquid crystal panel 6 on the basis of a control signal 17. 6 denotes a liquid crystal panel, being an active-matrix type liquid crystal panel, such as a TFT (Thin Film Transistor) liquid crystal panel, or the like.

Next, the operation of the device is described. Signals 11, such as a clock signal (CLK), a horizontal synchronization signal (HD), a vertical synchronization signal (VD), a data interval normalizing signal (DENA), a data signal (RGB DATA) input to the liquid crystal display, are input to the timing controller 1. Image data 12 consisting of 8-bit RGB data respectively, is input from the timing controller 1 to the frame memory 2. The image data (previous image data) used to display the previous frame, as input from the timing controller 1, is stored in the frame memory 2. The timing controller 1 outputs control signals 16, 17 for controlling the signal line drive circuit 4 and the scanning line drive circuit 5, to the respective drive circuits 4, 5, and it outputs the current image data 14 to the data comparing and corrected data generating means 3.

The data comparing and corrected data generating means 3 compares the current image data 14 input from the timing controller 1 with the previous image data 13 transferred from the frame memory 2, generates corrected data, and outputs same to the signal line driving circuit 4. Liquid crystal applied voltages corresponding to the corrected data 15 comprising respective 8-bit RGB data input by the signal line driving circuit 4 is supplied to the liquid crystal panel 6.

In this way, a frame memory for storing the previous image data for each picture element is required in order for the data comparing and corrected data generating means 3 to generate corrected data by comparing the previous image data 13 with the current image data 14. Moreover, in order to correct the liquid crystal applied voltages, in the data comparing and corrected data generating means 3, it is possible to adopt either a method whereby a look-up table is provided for reading out corrected data according to the relationship between the previous image data and the current image data, or a method whereby corrected data is determined by calculation from the relationship between the previous image data and the current image data. It is also possible for the data comparing and corrected data generating means 3 to be incorporated within the timing controller 1.

Further references disclosing prior technology include Japanese Patent Laid-open No. H5-183743, Japanese Patent Laid-open No. H5-336376, Japanese Patent Laid-open No. H10-143111, and Japanese Patent Laid-open No. H11-338424.

SUMMARY OF THE INVENTION

In the view of the foregoing, it is an object of the present invention to provide a liquid crystal display device which enables the capacity of image data memory storing previous image data to be reduced, thereby yielding a merit in that cost savings can be achieved.

It is another object of the present invention to provide a liquid crystal display device which allows the number of bits to be set with regard to the characteristics of the luminosity resolving ability of the human eye and hence it enables memory capacity to be reduced without causing image quality to decline.

It is further object of the present invention to provide a drive circuit for a liquid crystal display device which enables the capacity of image data memory storing previous image data to be reduced, thereby yielding a merit in that cost savings can be achieved.

According to one aspect of the present invention, for achieving the above-mentioned objects, there is provided a liquid crystal display device for implementing a liquid crystal display by inputting image data for achieving a gray shade display, comprising image data inputting means for inputting image data, image data memory for storing image data comprising a number of bits which is fewer than the number of bits in the image data input to the image data inputting means, on the basis of this image data, corrected data generating means for generating corrected data by correcting the current image data input to the image data inputting means, on the basis of previous image data stored in the image data memory, and liquid crystal driving means for inputting the corrected data and driving liquid crystals.

According to another aspect of the present invention, for achieving the above-mentioned objects, there is provided a liquid crystal display device, wherein the number of bits of image data stored in the image data memory is set on the basis of the gray scale data and the display luminosity characteristics of the liquid crystal display device.

According to one aspect of the present invention, for achieving the above-mentioned objects, there is provided a drive circuit device for a liquid crystal display device for driving a liquid crystal display by inputting image data for achieving a gray shade display, comprising image data inputting means for inputting image data, image data memory for storing image data comprising a number of bits which is fewer than the number of bits in the image data input to the image data inputting means, on the basis of this image data, corrected data generating means for generating corrected data by correcting the current image data input to the image data inputting means, on the basis of previous image data stored in the image data memory, and liquid crystal driving means for inputting the corrected data and driving liquid crystals.

The above and further objects and novel features of the invention will more fully appear from the following detailed description when the same is read in connection with the accompanying drawings. It is to be expressly understood, however, that the drawings are for purpose of illustration Only and are not intended as a definition of the limits of the invention.

BRIEF DESCRIPTION OF THE DRAWINGS

FIG. 6 is a table showing an overview of the memory capacity for the frame memory, the memory capacity for the look-up table, and the number of bus lines in case of various bits processing;

FIG. 8 is a table showing an overview of the memory capacity for the frame memory, the memory capacity for the look-up table, and the number of bus lines in case of various bits processing;

FIG. 9 is a table showing an overview of the memory capacity for the frame memory, the memory capacity for the look-up table, and the number of bus lines in case of various hits processing;

FIG. 13 is a table showing an overview of the memory capacity for the frame memory and the number of bus lines in case of various bits processing;

FIG. 14 is a table showing an overview of the memory capacity for the look-up table, and the number of bus lines in case of various bits processing;

DETAILED DESCRIPTION OF THE PREFERRED EMBODIMENTS

Firstly, a general outline of the present invention will be described. In general, in a display where the luminosity of the display screen changes rapidly, as in a moving image, if the amount of change in the luminosity is low, the luminosity resolving capacity of the human eye is also low and the eye is not highly sensitive to changes between adjacent colour tones. Therefore, in the embodiment of the present invention, the aforementioned problems of the prior art are resolved by paying attention to the luminosity resolving capacity of the human eye.

Figure 1:
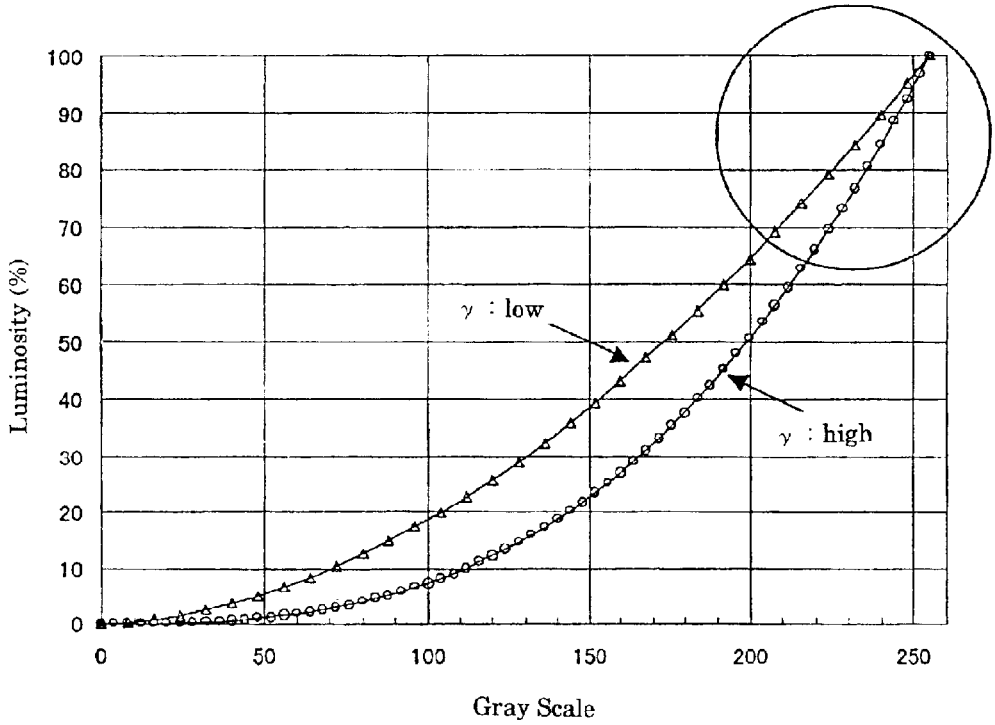
FIG. 1 is a drawing showing gray scale/luminosity characteristics for a liquid crystal display device.

In this method, by using the most significant bits of bits for gray scale, for example, the number of bits in the previous image data stored in the frame memory is reduced below the number of bits for gray scale used in the liquid crystal display device, and hence the memory capacity is reduced and costs are lowered. The number of bits in the stored previous image data is determined by the gray scale/luminosity characteristics of the liquid crystal display device. FIG. 1 shows gray scale/luminosity characteristics for a liquid crystal display device. Of the points indicated by the triangle shapes in the diagram, the points other than the 255th tone are points of 8-bit data having the 3 least significant bits set to 0, in other words, points indicating the gray scale/luminosity characteristics in a case where only the 5 most significant bits are used. In other words, the points indicated by the triangles indicate image data which can be represented when only the 5 most significant bits are used. More specifically, these points are the scattered data elements: "00000000", "00001000", "00010000", "00011000"–"11100000", "11101000", "11110000", "11111000". Of the points indicated by the circle shapes in the diagram, the points other than the 255th tone are points of 8-bit data having the 2 least significant bits set to 0, in other words, points indicating the gray scale/luminosity characteristics in a case where only the 6 most significant bits are used. In other words, the points indicated by the triangles indicate image data which can be represented when only the 5 most significant bits are used. More specifically, these points are the scattered data elements: "00000000", "00000100", "00001000", "00001100"–"11110000", "11110100", "11111000", "11111100". The difference in luminosity between the triangle and circle symbols with respect to the same tone, is the difference in the respective γ values representing the relationship between gray scale and luminosity, and here $\gamma(\Delta)<\gamma(O)$. The luminosity can be represented by the γ factor of the gray scale. In this example, it is assumed that $\gamma(\Delta)=1.8$ and $\gamma(O)=2.8$.

Figure 2:
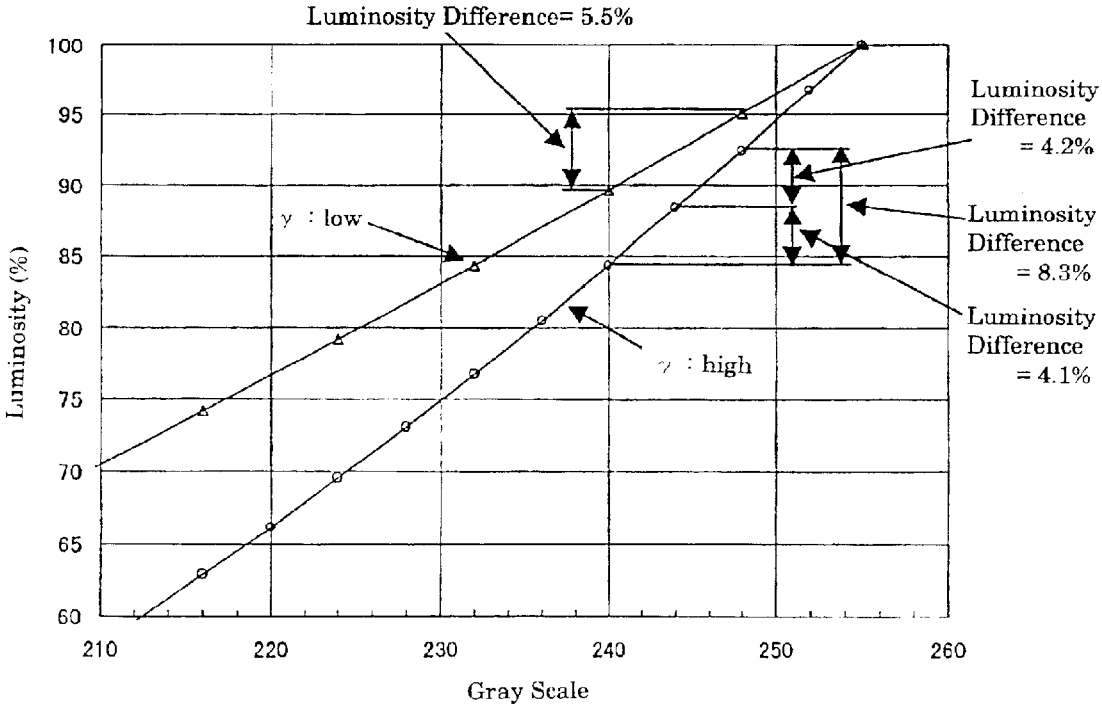
FIG. 2 is a drawing showing gray scale/luminosity characteristics for a liquid crystal display device.

FIG. 2 shows an expanded view of the portion enclosed by the circle in FIG. 1. In FIG. 2, the luminosity differentials between tone 240 and tone 248 for the respective γ values are shown. When $\gamma=1.8$, the luminosity differential is 5.5% and as the γ value increases, the luminosity differential increases and it takes a value of 8.3% when $\gamma=2.8$. This tendency is marked for brighter tones. In this way, when γ is small, it can be regarded that no display problems will occur if the number of bits processed is reduced to the most significant 4 bits or the most significant 5 bits. However, when γ is high, the luminosity differential is also large, and hence there is a possibility that the display will appear unnatural if the number of bits processed is small. In such cases, the most significant 6 bits or 7 bits are processed. In this way, if the γ value is high, the display is optimized by increasing the number of bits stored and processed, and if the γ value is low, the power consumption is lowered by reducing the number of bits stored and processed.

In the second method, in the case of a liquid crystal display device which permits variation of the γ value, the number of data bits stored and processed can be changed according to the current γ value information, in such a manner that, when the γ value is high, the display is optimized by increasing the number of bits stored and processed, and when the γ value is low, power consumption is lowered by reducing the number of bits stored and processed.

Embodiment 1

Figure 3:
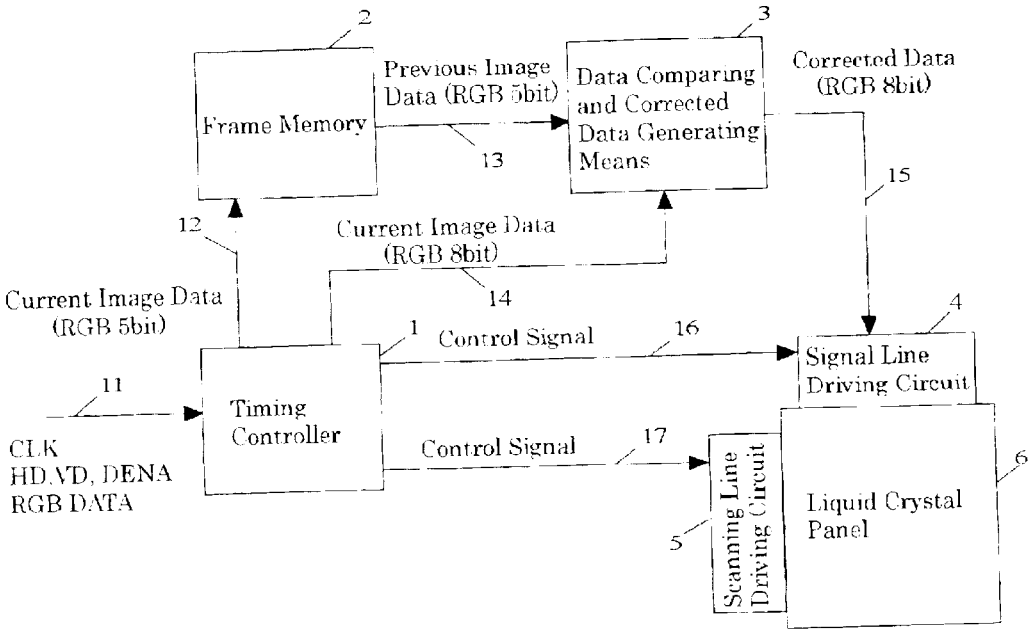
FIG. 3 is a block diagram of the liquid crystal display device of the first embodiment of the present invention.

FIG. 3 is a block diagram of the present embodiment. In the example in FIG. 3, the resolution is XGA (1024×3×768), and only the portion of the 256-gray scale display liquid crystal display device which relates to signal processing is illustrated. The basic operation of the timing controller 1, frame memory 2 and data comparing and corrected data generating means 3 are similar to the prior art. However, the number of data bits of the image data 12 that is transferred from the timing controller 1 to the frame memory 2 is only the most significant 5 bits of the respective 8 bits of RGB data. For example, if the image data is "11011001", then only "11011" is transferred.

In order to realize an image data transfer of this kind, the timing controller 1 outputs the most significant 5 bits of each respective RGB data element, from the current image data 12, to the frame memory 2. The frame memory 2 inputs the most significant 5 bits of the respective RGB data, for the current image data 12, and stores these data bits in a prescribed storage region. The timing controller 1 transfers the respective 8 bits of RGB data of the current image data 14 to the data comparing and corrected data generating means 3. The timing controller 1 inputs the current image data 14 comprising respective 8 bits of RGB data, and also reads out the previous image data 13 comprising respective most significant 5 bits of RGB data stored in the prescribed storage region of the frame memory 2.

The data comparing and corrected data generating means 3 then generates corrected data 15 comprising respective 8 bits of RGB data, on the basis of the previous image data 13 and the current image data 14. This corrected data generating method is described after in detail. The corrected data 15 is input along with the control signal 16 output by the timing controller 1 to the signal line driving circuit 4, which drives the signal lines of the liquid crystal panel 6. A control signal 17 is input from the timing controller 1 to the scanning line driving circuit 5, whereby the scanning lines of the liquid crystal panel 6 are driven.

By adopting this arrangement, the frame memory capacity required to generate corrected data is 1024×3×768×5=3×3.75 Mbit=11.25 Mbit, which represents a reduction in memory capacity compared to the prior art, and in practice, it is sufficient to use a single 16-Mbit memory. If three memories are used, then each is required to have a memory capacity of 4 Mbit is achieved, thereby reducing costs in comparison with the prior art. Furthermore, since the number of bus lines between the timing controller 1 and the frame memory 2 can be reduced from 24 to 15, it is possible to reduce the scale of the circuit board on which the device is mounted, whilst also improving design freedom.

Figure 4:
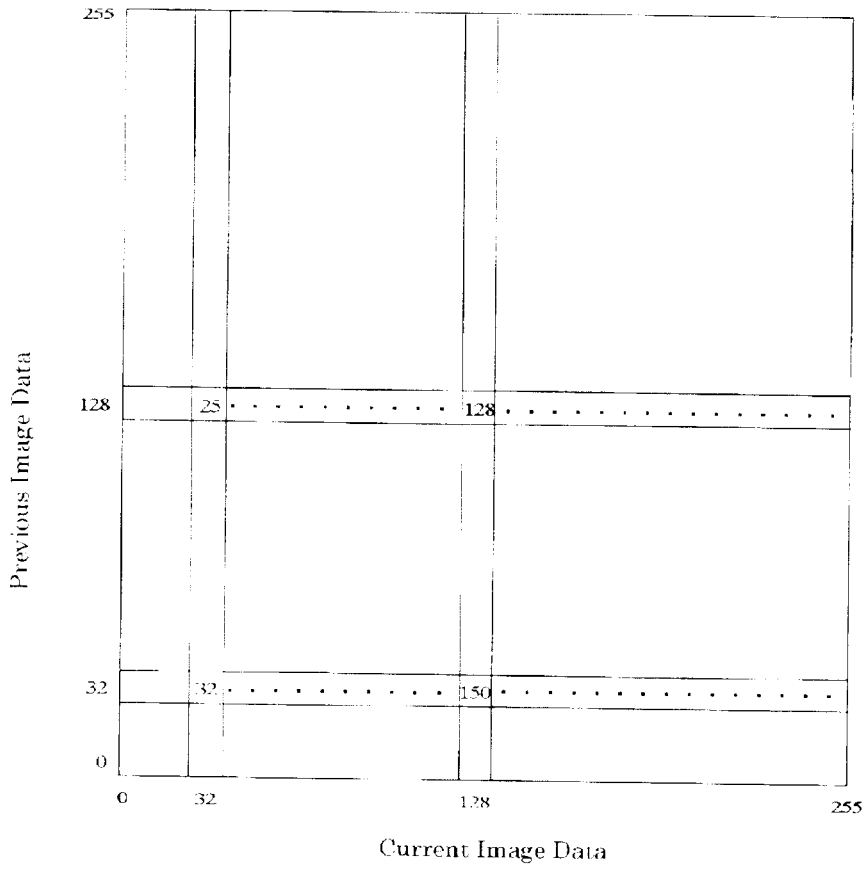
FIG. 4 is a drawing showing a example of a look-up table.
Figure 5:
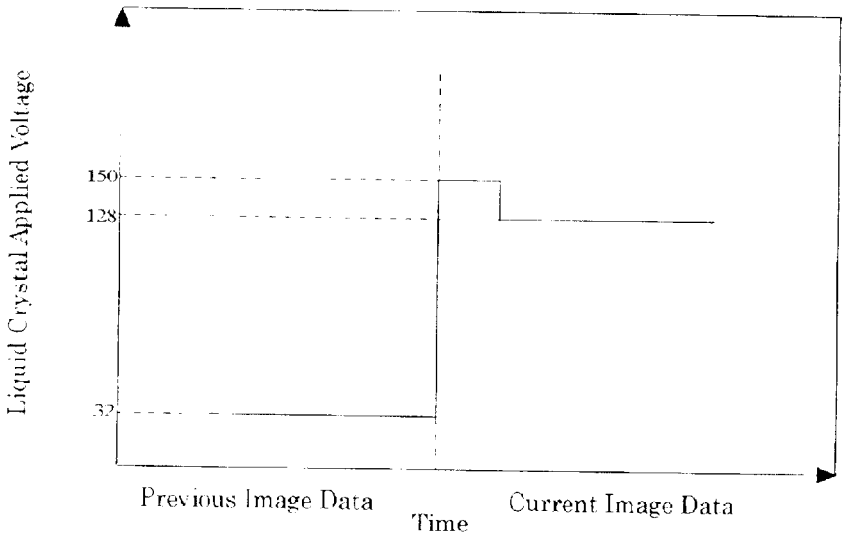
FIG. 5 is a schematic diagram showing a liquid crystal applied voltage.

A case where a look-up table for reading out corrected data from the relationship between the previous image data and the current image data is used as the data comparing and corrected data generating means 3 is described here with reference to FIG. 4 and FIG. 5. FIG. 4 shows an example of a look-up table. In this look-up table, the vertical axis indicates previous image data and the horizontal axis indicates current image data. In this embodiment of the present invention, as described previously, the previous image data is represented by the most significant 5 bits of the respective 8-bit RGB data elements, whilst the current image data is represented by 8-bit data. In FIG. 4, the respective image data are expressed in decimal form.

To give a more concrete example, if, for instance, the value of the previous image data is "32" and the value of the current image data is "32", then since there is no change in the image data, it is not particularly necessary to apply a correction, and hence the data stored in this intersection region is the same value "32". If the previous image data is "32" and the current image data is "128", then the data "150" is stored in the corresponding intersection region. Thereby, as shown in FIG. 5, by switching from the previous image data to the current image data, starting from a liquid crystal applied voltage corresponding to "32", a liquid crystal applied voltage corresponding to "150" is applied temporarily, whereupon, after a predetermined time period, a liquid crystal applied voltage corresponding to "128" is applied.

If the previous image data is "128" and the current image data is "32", then the data "25" is stored in the corresponding intersection region. Thereby, when switching from the previous image data to the current image data, after the liquid crystal applied voltage corresponding to "128", a liquid crystal applied voltage corresponding to "25" is applied temporarily, whereupon, after a predetermined time period, a liquid crystal applied voltage corresponding to "32" is applied.

If a look-up table for reading out corrected data according to the relationship between the previous image data and the current image data is used as data comparing and corrected data generating means 3, then the memory capacity of the look-up table required to compare each of the most significant 5 bits of RGB data in the previous image data with each of the most significant 8 bits of RGB data in the current image data in order to generate RGB 8-bit corrected data, is 3 ×32×256×8=3×64 Kbit=192 Kbit. Therefore, the memory capacity can be reduced compared to the prior art, and in practical use, a single 256 Kbit memory is sufficient. If three memories are used, each is required to have a memory capacity of 64 Kbit only, thereby reducing costs compared to the prior art. Moreover, since the number of bus lines between the frame memory 2 and the data comparing and corrected data generating means 3 can be reduced from 24 to 15, it is possible to reduce the scale of the circuit board on which these devices are mounted, whilst also increasing freedom of design.

Moreover, whereas conventionally the 8 bits of the previous image data are compared with the 8 bits of the current image data, in the present embodiment, 5 bits of the previous image data are compared with 8 bits of current image data, and hence the number of data bits processed can be reduced, and savings in power consumption can be expected.

Moreover, if the data comparing and corrected data generating means 3 is incorporated within the timing controller 1, the internal memory capacity required in the timing controller 1 can be reduced, and hence costs can be reduced.

The description of the present embodiment related to 5-bit processing, but any processing involving 7 bits or less will lead to a reduction in costs and the number of bus lines due to reduction in the memory requirement, compared with the prior art technology, thereby leading to the possibility of reduced size of related circuit boards, increased design freedom, and reduced power consumption.

FIG. 6 gives an overview of the memory capacity required for the frame memory, the memory capacity required for the look-up table, and the number of bus lines between the timing controller and frame memory, and the number of bus lines between the frame memory 2 and the data comparing and corrected data generating means 3, in the case of 7-bit, 6-bit, 5-bit, 4-bit, 3-bit and 2-bit processing, respectively, when a look-up table is used as the data comparing and corrected data generating means 3. The resolution is XGA (1024×3×768). In the table in FIG. 6, the same number of bits are processed for RGB data, respectively, but the number of bits processed may be mutually different.

As a method for determining the number of data bits to be stored and processed, depending on the gray scale/luminosity characteristics of the liquid crystal display device, if the luminosity difference between gray scales is large ($\gamma$ value is high), then the display is optimized by increasing the number of data bits stored and processed, and if the $\gamma$ value is low, then the power consumption is reduced by reducing the number of bits stored and processed.

If using an SDRAM for the frame memory storing the previous image data, in a 16 Mbit memory which is commonly used for a frame memory, the number of bus lines is 16. In terms of display performance, the higher the number of data bits stored, the better, but when memory and data input and output processing speed are taken into account, it is desirable to process a number of data bits equal to or less than the number of bus lines. Therefore, if a 16 Mbit SDRAM is used, it is appropriate to process a total of 16 bits of data for the RGB data.

For example, if a liquid crystal display device having resolution of XGA (1024×3×768) and using an 8-bit display for each colour, RGB, is used, then taking EMI countermeasures, and the like, into account, a system may be adopted whereby the respective RGB data are divided by the timing controller into data OR, OG, OB corresponding to odd-numbered pixels, and data ER, EG, EB corresponding to even-numbered pixels, the frequency is reduced by half, and the data are transferred to the signal line driving circuit. In a liquid crystal display device of this kind, in order save all 8 bits of each data element, OR, OG, OB, ER EG, EB, a memory capacity of (1024/2) ×6×768×8=18 Mbit is required. Furthermore, if a look-up table for reading out corrected data according to the relationship between the previous image data and the current image data is used as data comparing and corrected data generating means 3, then it will require a capacity of 6×256 ×256×8=3 Mbit.

However, as one example of applying the present embodiment to a liquid crystal display device of this type, if a method is used where a total of 16 bits are processed, namely, the most significant 3 bits of OR, the most significant 3 bits of OG, the most significant 2 bits of OB, the most significant 3 bits of ER, the most significant 3 bits of EG, and the most significant 2 bits of EB, then the capacity required for the frame memory will be $$(1024/2)\times4\times768\times3+(1024/2)\times2\times768\times2=6\text{ Mbit}$$

and hence a single 16 Mbit memory is sufficient, and memory capacity can thus be reduced compared to the prior art. By setting the total number of data bits to be stored to 16 hits, equal to the number of bus lines of the memory, the data input/output processing is also simplified.

If a look-up table for reading out corrected data according to the relationship between the previous image data and the current image data is used as data comparing and corrected data generating means 3, then the capacity of the look-up table required to generate corrected 8-bit data for OR, OG, OB, ER, EG, EB, by respectively comparing the most significant 3 bits of OR, the most significant 3 bits of OG, the most significant 2 bits of OB, the most significant 3 bits of ER, the most significant 3 bits of EG and the most significant 2 bits of EB in the previous image data, with the respective 8-bit data for OR, OG, OB, ER, EG and EB in the current image data, can be reduced to $$4\times8\times256\times8+2\times4\times256\times8=80\text{ Kbit.}$$

Apart from this method, the number of bits processed can also be determined on the basis of the data processing speed of the frame memory 2 and the look-up table, restrictions for the number of bus line, and cost. If the data comparing and corrected data generating means 3 is incorporated in the timing controller 1, then it may also be determined on the basis of the memory capacity installable in the timing controller 1, shape restrictions and related costs. Furthermore, it is also possible for the number of bits processed to be determined with reference to the differences caused by the characteristics values of the liquid crystal materials, the driving frequency of the liquid crystal display device, and the like.

Embodiment 2

Figure 7:
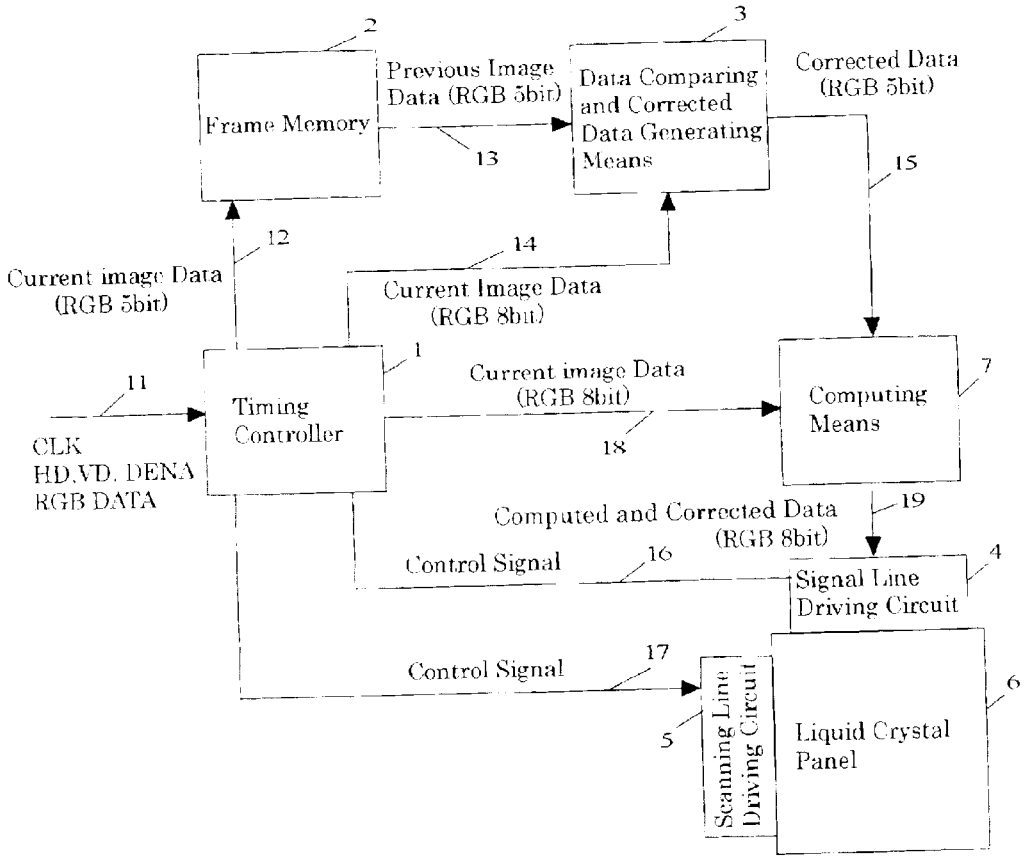
FIG. 7 is a block diagram of the liquid crystal display device of the second embodiment of the present invention.

FIG. 7 shows a block diagram of a second embodiment. In FIG. 7, only that part of a liquid crystal display device having resolution of XGA (1024×3×768) and a 256-colour tone display which relates to signal processing is depicted. The basic operation of the timing controller 1, frame memory 2, and data comparing and corrected data generating means 3 are the same as in the prior art. In this second embodiment, similarly to the first embodiment, the number of data bits of the current image data 12 transferred from the timing controller 1 to the frame memory 2 is only the most significant 5 bits of each respective 8-bit RGB data element. The number of data bits of the current image data 14 transferred from the timing controller 1 to the data comparing and corrected data generating means 3 is 8 bits for each RGB data element.

In the present embodiment, new computing means 7 is provided. This computing means 7 generates 8-bit data 19 to output to the signal line driving circuit 4, by computing the 5-bit corrected data 15 and 8-bit current image data 18 input from the data comparing and corrected data generating means 3. More specifically, for example, it generates data 19 for outputting to the signal line driving circuit 4 by extracting the least significant 3 bits of the 8-bit current image data 18, and adding the extracted least significant 3 bits of the current image data as the least significant bits of the 5-bit corrected data 15. Besides this, it is also possible, for example, to generate 8-bit corrected data 19 by computing the 5-bit corrected data 15 on the basis of the 8-bit current image data.

In the present embodiment, the number of data bits transferred from the timing controller 1 to the frame memory 2 is only the most significant 5 bits of each 8-bit RGB data element. Accordingly, the required frame memory capacity is $$1024\times3\times768\times5=3\times3.75\text{ Mbit}=11.25\text{ Mbit,}$$

thereby allowing the memory capacity to be reduced compared to the prior art, and in practice, a single 16 Mbit memory is sufficient. Moreover, if three memories are used, then each is required to have a capacity of 4 Mbit only, thereby allowing costs to be reduced compared to the prior art. Furthermore, since the number of bus lines between the timing controller 1 and the frame memory 2 can be reduced from 24 lines in the prior art to 15 lines, the scale of the circuit board on which these devices are mounted can be reduced, whilst also increasing freedom of design.

Moreover, in the present embodiment, the data transferred from the frame memory 2 to the data comparing and corrected data generating means 3 is only the most significant 5 bits of the respective 8-bit RGB data. If a look-up table for reading out corrected data according to the relationship between the previous image data and the current image data is used as the data comparing and corrected data generating means 3, then the capacity of the look-up table required for comparing the most significant 5 bits of each RGB element of the previous image data with the respective 8-bit RGB elements of the current image data, in order to generate respective 5-bit RGB corrected data, will be $$3\times32\times256\times5=3\times40\text{ Kbit}=120\text{ Kbit}$$

and hence the memory capacity can be reduced compared to the prior art, and in practical use, a single 128 Kbit memory is sufficient, thereby reducing costs compared to the prior art. Moreover, since the number of bus lines between the frame memory 2 and the data comparing and corrected data generating means 3 can be reduced from 24 to 15, the size of the circuit board on which these devices are mounted can be reduced, whilst also increasing freedom of design.

Furthermore, whereas conventionally the 8 bits of the previous image data are compared with the 8 bits of the current image data, in the present embodiment, 5 bits of the previous image data are compared with 8 bits of current image data, and hence the number of data bits processed can be reduced, and savings in power consumption can be expected.

In the present embodiment, the data comparing and corrected data generating means 3 and computing means 7 are provided as mutually independent elements, but it is also possible to incorporate one or both of these elements into the timing controller 1. According to the present embodiment, if the data comparing and corrected data generating means 3 is incorporated into the timing controller 1, then the internal memory capacity required in the timing controller 1 is reduced, and hence cost savings can be achieved.

FIG. 8 gives an overview of the memory capacity required for the frame memory, the memory capacity required for the look-up table, and the number of bus lines between the timing controller 1 and frame memory, and the number of bus lines between the frame memory and the data comparing and corrected data generating means, in cases where the number of current image data bits transferred to the frame memory 2, and the number of previous image data bits transferred to the data comparing and corrected data generating means 3, is 7 bits, 6 bits, 5 bits, 4 bits, 3 bits and 2 bits, respectively, when a look-up table is used as the data comparing and corrected data generating means 3. The resolution is XGA (1024×3×768). In this table, the corrected data is taken to have the same number of bits as the number of bits of previous image data stored in the frame memory 2. Moreover, the current image data input from the timing controller 1 to the data comparing and corrected data generating means 3 is 8-bit data. In FIG. 8, the same number of bits are processed for RGB data, respectively, but the number of bits processed may be mutually different.

In the present embodiment, the current image data input from the timing controller 1 to the computing means 7 was all taken as 8-bit data, but it is also possible to reduce the number of bus lines between the timing controller 1 and the computing means 7, if, for example, the least significant 3 bits of each 8-bit RGB element of the current image data is input to the computing means 7.

In the present embodiment, the number of current image data bits in the data input to the data comparing and corrected data generating means 3 was taken as 8 bits, but if the previous image data comprises the most significant 5 bits for the respective RGB elements, then the number of current image data bits may be set anywhere between the most significant 5 and the most significant 8 bits of the RGB data, the smaller this number of bits, the greater the effects of reducing circuit board size, increasing design freedom, and reducing power consumption, achieved due to the consequent memory reduction and associated cost savings and bus lines reduction. For example, if the most significant 5 bits of RGB data in the previous image data, and the most significant 5 bits of RGB data in the current image data are input to the data comparing and corrected data generating means 3, then the memory capacity required for the look-up table can be reduced to $$3\times32\times32\times5=3\times5\ \text{Kbit}=15\ \text{Kbit}$$

FIG. 9 gives an overview of the memory capacity required for the frame memory 2, the memory capacity required for the look-up table, and the number of bus lines between the timing controller 1 and frame memory 2, and the number of bus lines between the frame memory 2 and the data comparing and corrected data generating means 3, in cases where the number of current image data bits transferred to the frame memory 2, and the number of previous image data bits transferred to the data comparing and corrected data generating means 3, is 7 bits, 6 bits, 5 bits, 4 bits, 3 bits and 2 bits, respectively, when a look-up table is used as the data comparing and corrected data generating means 3. In this table, the corrected data is taken as data having the same number of bits as the number of bits of previous image data stored in the frame memory 2. Furthermore, the current image data input from the timing controller 1 to the data comparing and corrected data generating means 3 is taken as data having the same number of data bits as the number of previous image data bits stored in the frame memory 2. In the table in FIG. 9, the same number of bits are processed for RGB data, respectively, but the number of bits processed may be mutually different.

In the present embodiment, the previous image data stored in the frame memory 2 and the previous image data transferred to the data comparing and corrected data generating means 3 is taken as the most significant 5 bits of the respective 8-bit RGB data elements, but provided that it is set to 7 bits or fewer, then memory reduction can be achieved compared to the prior art, thereby allowing cost savings and bus line reduction, and hence leading to reduced circuit board size, increased design freedom, and reduced power consumption.

Taking the number of data bits as I bits (I=2, 3, 4, 5, 6, 7), then the number of processed bits may be anywhere between I bits and 8 bits, the smaller the number of bits, the greater the effects of reduced circuit board size, increased design freedom, and reduced power consumption achieved due to memory reduction and the consequent cost saving and bus line reduction effects.

As a method for determining the number of bits to be processed, it is possible to determine the number of bits from the γ value of the liquid crystal display device, as stated previously, or to determine the number of bits on the basis of the memory capacity, shape restrictions, and cost of the devices used, for example, frame memory 2, data comparing and corrected data generating means 3, computing means 7, and timing controller 1. It is also possible to determine the number of bits according to differences caused by the characteristic values of the liquid crystal materials, the driving frequency of the liquid crystal display device, and the like.

Embodiment 3

The embodiments described thus far have related to cases where the number of bits to be processed is fixed, but below, an embodiment is described wherein the γ value of can be varied, for example.

Figure 10:
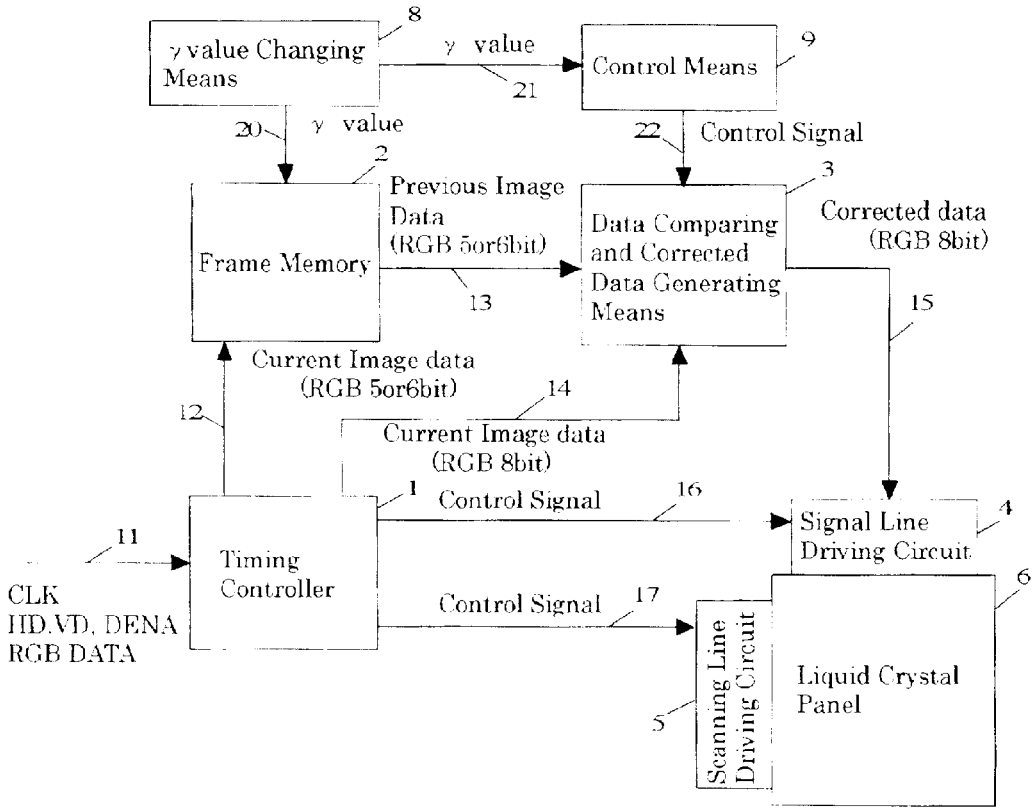
FIG. 10 is a block diagram of the liquid crystal display device of the third embodiment of the present invention.
Figure 18:
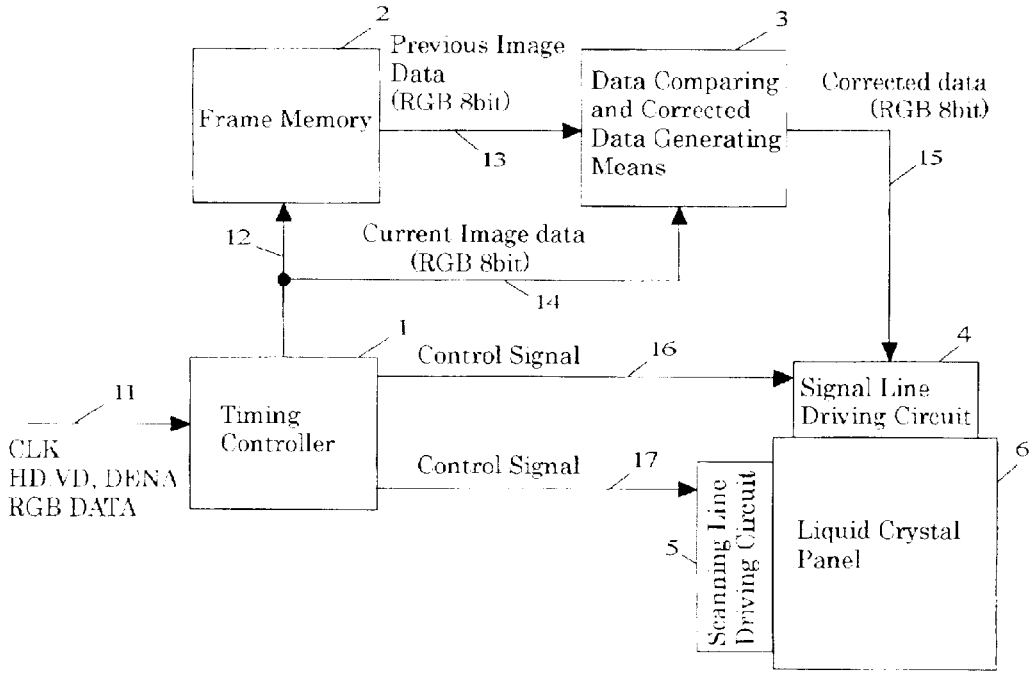
FIG. 18 is a block diagram of liquid crystal display device of the related art.

FIG. 10 shows a block diagram of the present embodiment. In the example in FIG. 10, only that part of a liquid crystal display device having resolution of XGA (1024×3×768) and a 256-colour tone display which relates to signal processing is depicted. The basic operation of the timing controller 1, frame memory 2, and data comparing and corrected data generating means 3 are the same as in the prior art. In the present embodiment, new γ value changing means 8 and control means 9 for controlling the data comparing and corrected data generating means 3 are provided. The γ value can be changed by the γ value changing means 8, and information relating to the current γ value is input from the γ value changing means 8 to the frame memory 2 and control means 9. On the basis of the input γ value information, the frame memory sets the number of bits of current image data 12 to be input and stored by the timing controller 1 to 5 bits, if the γ value is lower than a predetermined value, and it sets the number of bits of current image data 12 to be input and stored by the timing controller to 6 bits, if the γ value is higher than a predetermined value. Moreover, depending on the input γ value, the control means 9 sends a control signal 22 instructing input of 5-bit previous image data 13 from the frame memory 2, to the data comparing and corrected data generating means 3, if the γ value is lower than the prescribed value, and it sends a control signal 22 instructing input of 6-bit previous image data 13 from the frame memory 2, to the data comparing and corrected data generating means 3, if the γ value is higher than the predetermined value. The data comparing and corrected data generating means 3 inputs the prescribed number of bits of previous image data 13 and the 8-bit current image data 14, on the basis of this control signal 22, performs comparison processing and corrected data generation processing, and outputs 8-bit corrected data 15 to the signal line driving circuit 4. The signal line driving circuit 4 inputs this corrected data 15 and the control signal 16, and drives the liquid crystal panel 6 in conjunction with the scanning line driving circuit 5.

As is clear from the first and second embodiments of the present invention, in 5-bit processing and 6-bit processing, the memory capacity required in the frame memory 2 and data comparing and corrected data generating means 3 is different, a larger memory capacity being required in the case of 6-bit processing. Therefore, in the present embodiment, a frame memory capacity of $$1024\times3\times768\times6=3\times4.5\text{ MBit}=13.5\text{ MBit}$$

is required. If a look-up table for reading out corrected data according to the previous image data and current image data is used as the data comparing and corrected data generating means 3, then the look-up table will require a memory capacity of:

$$3\times64\times256\times8=3\times128\text{ Kbit}=384\text{ Kbit}$$

These memory capacity values are smaller than the prior art, and allow cost reductions to be made. By using a rewriteable memory, such as an EEP-ROM, or the like, for the look-up table, and rewriting the contents of the look-up table for respective γ values, on the basis of the γ value information, by means of a microcomputer, or the like, forming control means, it is possible to generate corrected data that is optimal with regard to the γ value.

According to this third embodiment, since the corrected data is optimized with regard to the γ value in liquid crystal display devices having a variable γ value, optimum driving can be achieved for respective γ values. Moreover, since the number of data bits processed is fewer than the prior art, power consumption savings can be anticipated. Moreover, since 5-bit processing is implemented if the γ value is small, then a greater power consumption reduction can be achieved compared to cases where the γ value is large and 6-bit processing is implemented.

In the present embodiment, the γ value is described as switching between two values, small and large, but in a composition wherein the γ value changes in a continuous fashion between small and large values, it is possible to achieve similar beneficial effects by switching to 5-bit processing when the γ value is within a certain range, and switching to 6-bit processing when it is in a different range.

This embodiment described a case where processing switched between 5-bit and 6-bit processing, but optimisation of driving conditions can also be achieved if switching between 3 or more types of processing, such as 5-bit, 6-bit and 7-bit processing.

It is also possible for the γ value changing means 8 and the data comparing and corrected data generating means 3 to be incorporated within the timing controller 1. According to the present embodiment, even if the data comparing and corrected data generating means 3 is incorporated within the timing controller 1, the internal memory capacity required in the timing controller will be reduced, and hence cost reductions can be achieved.

Embodiment 4

Figure 11:
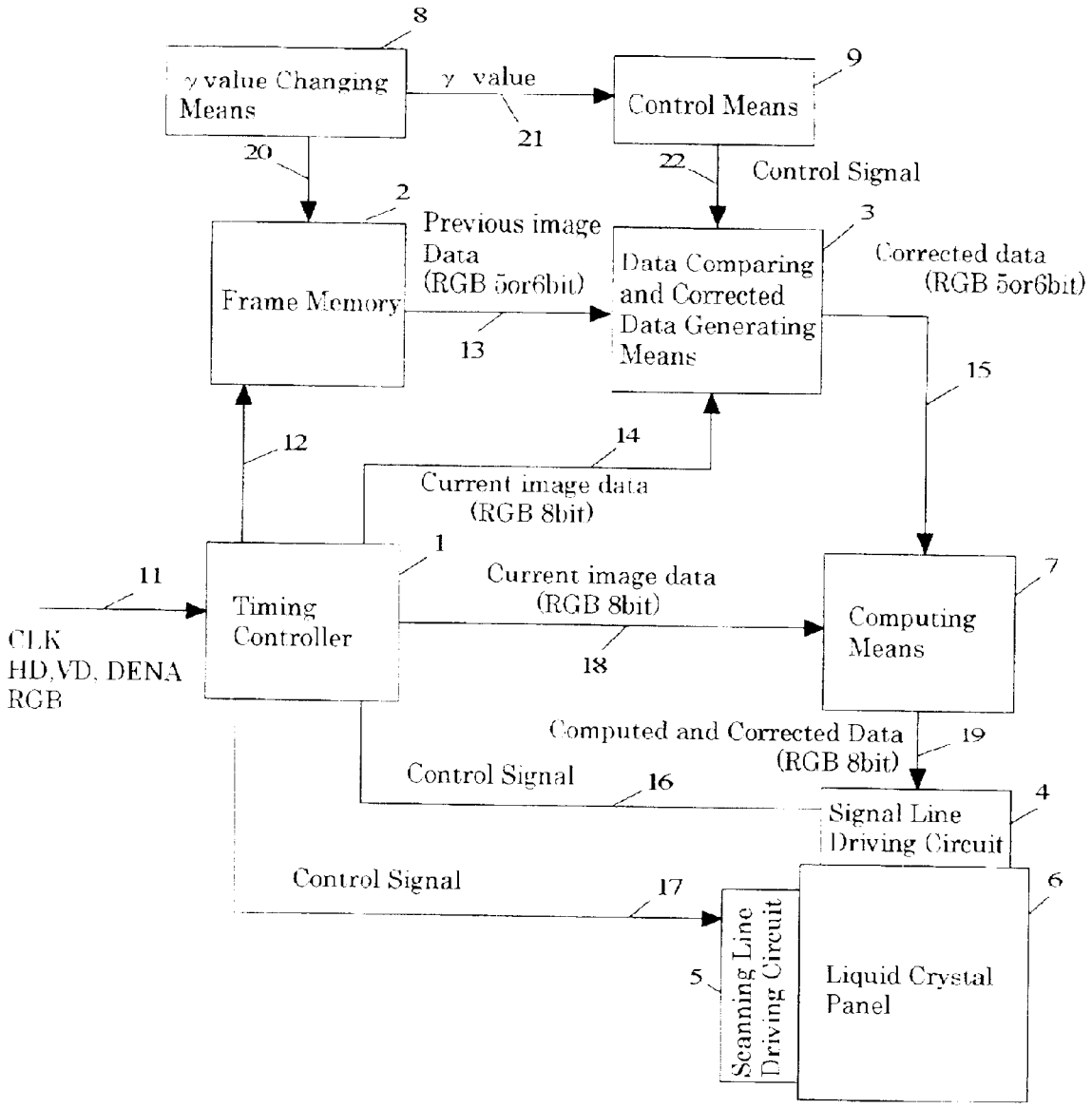
FIG. 11 is a block diagram of the liquid crystal display device of the fourth embodiment of the present invention.

FIG. 11 shows a block diagram of a fourth embodiment of the present invention. In the example in FIG. 11, only that part of a liquid crystal display device having resolution of XGA (1024×3×768) and a 256-colour tone display which relates to signal processing is depicted. The basic operation of the timing controller 1, frame memory 2, and data comparing and corrected data generating means 3 are the same as in the prior art. In this embodiment, a new γ value changing means 8 and control means 9 for affecting the data comparing and corrected data generating means 3 are provided. The γ value can be changed by the γ value changing means 8, which affects the frame memory 2 and control means 9 in such a manner that processing corresponding to the current γ value is implemented.

On the basis of the input γ value information, the frame memory 2 sets the number of data bits of the current image data 12 to be input and stored by the timing controller 1, to 5 bits, if the γ value is smaller than a predetermined value, and it sets the number of data bits of the current image data 12 to be input and stored by the timing controller 1, to 6 bits, if the γ value is greater than a predetermined value. Furthermore, on the basis of the input γ value information, the control means 9 sends a control signal 22 instructing input of 5-bit previous image data 13 from the frame memory 2, to the data comparing and corrected data generating means 3, if the γ value is lower than a predetermined value, and it sends a control signal 22 instructing input of 6-bit previous image data 13 from the frame memory 2, to the data comparing and corrected data generating means 3, if the γ value is higher than the predetermined value.

Moreover, by newly providing computing means 7, 8-bit data for output to the signal line driving circuit 4 is generated by computing the 5-bit or 6-bit corrected data 15 and the 8-bit current image data 18 input to the computing means 7 from the data comparing and corrected data generating means 3.

As understood in the first and second embodiments, 5-bit processing and 6-bit processing require respectively different memory capacities in the frame memory 2 and data comparing and corrected data generating means 3, a larger memory capacity naturally being required in the case of 6-bit processing. Therefore, in the present embodiment, the required frame memory capacity is $$1024\times3\times768\times6=3\times4.5\text{ Mbit}=13.6\text{ Mbit}.$$

If a look-up table for reading out corrected data according to the relationship between the previous image data and the current image data is used as data comparing and corrected data generating means 3, then the required memory capacity for the look-up table will be $$3\times64\times256\times8=3\times128\text{ Kbit}=384\text{ Kbit}.$$

This memory capacity is smaller than that required in the prior art, and hence costs can be reduced. By using a rewriteable memory, such as an EEP-ROM, or the like, for the look-up table, and rewriting the contents of the look-up table for respective γ values, on the basis of the γ value information, by means of a microcomputer, or the like, forming control means, it is possible to generate corrected data that is optimal with regard to the γ value.

According to this embodiment, since the corrected data is optimized with regard to the γ value in liquid crystal display devices having a variable γ value, optimum driving can be achieved for respective γ values. Moreover, since the number of data bits processed is fewer than the prior art, power consumption savings can be anticipated. Furthermore, since 5-bit processing is implemented if the γ value is small, then a greater power consumption reduction can be achieved compared to cases where the γ value is large and 6-bit processing is implemented.

In the present embodiment, the number of bits of current image data 14 in the data input to the data comparing and corrected data generating means 3 was taken as 8 bits, but if the previous image data comprises the most significant 5 bits for the respective RGB elements, then the number of current image data bits may be set anywhere between the most significant 5 and the most significant 8 bits of the RGB data. Moreover, if the previous image data 13 comprises the most significant 6 bits for the respective RGB elements, then the number of current image data bits may be set anywhere between the most significant 6 and the most significant 8 bits of the RGB data. The smaller this number of bits, the greater the effects of reducing circuit board size, increasing design freedom, and reducing power consumption, achieved due to the consequent memory reduction and associated cost savings and bus lines reduction.

In the present embodiment, the previous image data 13 stored in the frame memory 2 and the previous image data 13 transferred to the data comparing and corrected data generating means 3 is taken as the most significant 5 bits or the most significant 6 bits of the respective 8-bit RGB data elements, but provided that it is set to 7 bits or fewer, memory reduction can be achieved compared to the prior art, thereby allowing cost savings and bus line reduction, and hence leading to reduced circuit board size, increased design freedom, and reduced power consumption. As stated previously, taking the number of data bits as I bits (I=2, 3, 4, 5, 6, 7), the number of processed bits may be anywhere between I bits and 8 bits, the smaller the number of bits, the greater the effects of reduced circuit board size, increased design freedom, and reduced power consumption achieved due to memory reduction and the consequent cost saving and bus line reduction effects.

In the present embodiment, the γ value is switched between two values, large and small, but in a composition where the γ value changes linearly between small and large values, similar beneficial effects can be obtained by switching to 5-bit processing when the γ value is within a certain range, and switching to 6-bit processing when it is within another range.

The present embodiment described a case involving switching between two types of processing, 5-bit and 6-bit processing, but optimisation of driving conditions can also be achieved if switching between 3 or more types of processing, such as 5-bit, 6-bit and 7-bit processing. In this case, optimisation of the display driving conditions, and reduction of power consumption can be implemented in a more precise manner.

The γ value changing means 8, data comparing and corrected data generating means 3, and computing means 7 can be incorporated within the timing controller 1, and according to the present embodiment, even if the data comparing and corrected data generating means 3 is incorporated inside the timing controller 1, the internal memory capacity required in the timing controller 1 will be reduced, thereby leading to cost saving.

Embodiment 5.

Figure 12:
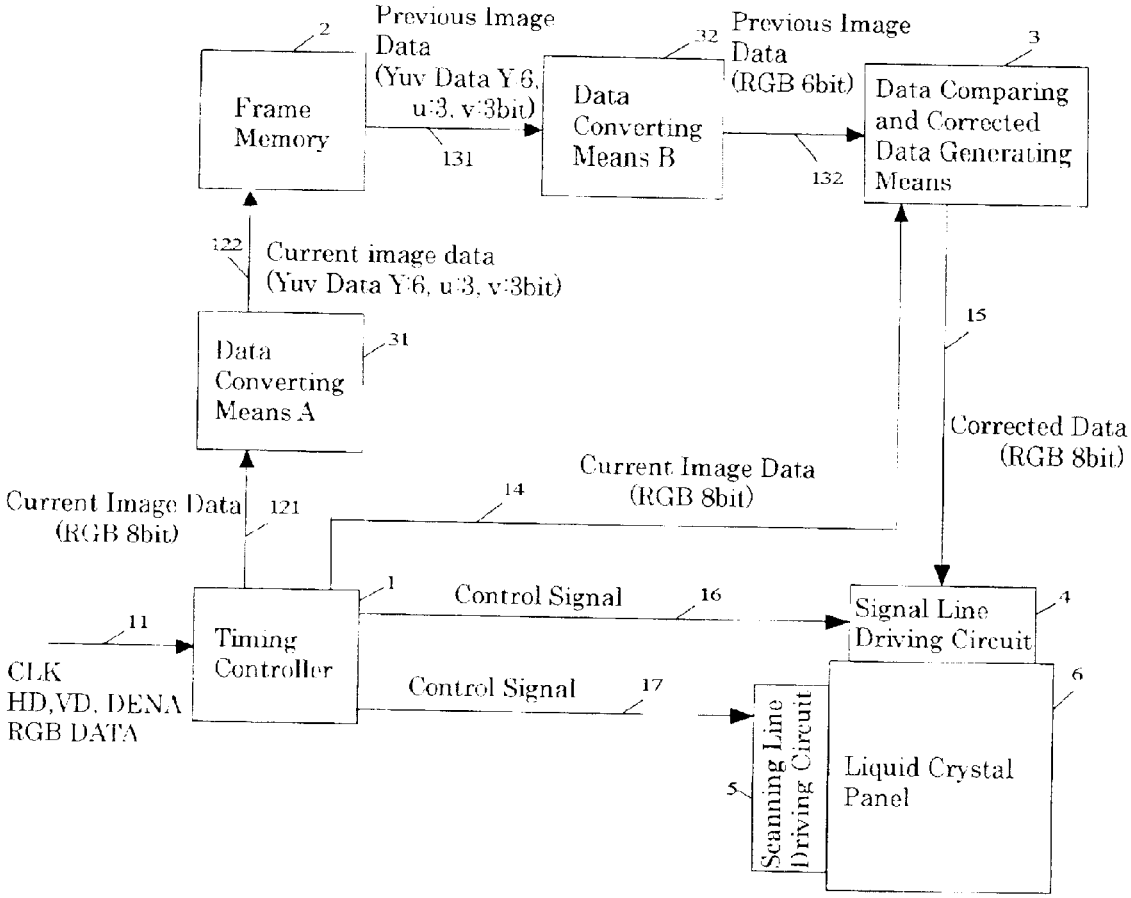
FIG. 12 is a block diagram of the liquid crystal display device of the fifth embodiment of the present invention.

FIG. 12 shows a block diagram relating to signal processing in a liquid crystal display device relating to a fifth embodiment. In this fifth embodiment, in particular, in the liquid crystal display device described in the first embodiment, the RGB data is converted to Yuv data and stored in the frame memory 2, and corrected data is then generated by converting the stored Yuv data to RGB data, and comparing this with the current image data.

As shown in FIG. 12, the current image data 121 comprising respective 8-bit RGB elements output by the timing controller 1 is input to data converting means A31. The data converting means A31 then converts the respective RGB 8-bit current image data 121 thus input to Yuv, and outputs this Yuv data 122. The Yuv data is composed of 12 bits of data, consisting of 6 bits of luminosity data Y, 3 bits of colour component u, and 3 bits of colour component v. This Yuv conversion can be implemented by means of a calculation formula conforming to the standard ITU-R.BT601. Generally, a human eye has lower resolving ability with respect to colour than with respect to luminosity, and hence no problems arise if the RGB data is converted into a luminosity component γ and colour components u, v, in this way.

The current image data 122 output by the data converting means A31 is stored in the frame memory 2. It is then read out at a prescribed timing, and output as previous image data 131. This previous image data 131 is 12-bit Yuv data. The previous image data 131 is input to data converting means B32, and converted back to RGB data. In this example, this RGB data is constituted by respective 6-bit RGB data elements. In the data comparing and corrected data generating means 3, the previous image data converted to RGB data is compared with the respective 8-bit RGB data of the current image data, to generate corrected RGB 8-bit data, which is output to the signal line driving circuit 4.

In this way, the frame memory 2 stores 12-bit Yuv data which has been converted by the data converting means A31, and hence the capacity required in the frame memory in order to generate corrected data is 1024×768×12=9 Mbit, which allows the memory capacity to be reduced compared to the prior art. Moreover, the number of bus lines between the data converting means A31 and the frame memory 2 can also be reduced to 12 lines. This description related to an example where the data was converted to 12-bit Yuv data, but the invention is not limited to this, and provided that the data is converted to data of 23 bits or fewer, it will be possible to reduce the memory capacity of the frame memory 2, and the number of bus lines between the data converting means A31 and the frame memory 2, thereby achieving the beneficial effects of the present invention. The corresponding relationships are illustrated in FIG. 13. The resolution is taken as XGA (1024×3×768).

In the data converting means B32, when converting the 12-bit Yuv data to RGB data, it is possible to use an algorithm to convert respective 4-bit RGB data to RGB data of any number of bits up to 8 bits. For example, if converting to respective 6-bit RGB data, the memory capacity of the related look-up table can be reduced to 3×64×256×8=384 Kbit. Moreover, the respective bit numbers for the RGB elements do not have to be the same, and mutually different bit numbers can be used for the R, G, and B elements.

This description related to the reduction of the memory capacity required for a look-up table in a case where the data is converted to respective 6-bit RGB data, but the invention is not limited to this, and the beneficial effects of the present invention can still be achieved provided that the RGB data is converted to data of 23 bits or fewer. FIG. 14 gives an overview of look-up table memory capacity, and the number of bus lines between the data converting means B32 and the data comparing and corrected data generating means 3, with respect to the number of data bits into which the data converting means B32 converts the RGB data. Here, the number of current image data bits input to the data comparing and corrected data generating means 3 is taken as 8 bits for the respective RGB elements, and the resolution is taken as XGA (1024×3×768).

The data converting means A31, data converting means B32 and data comparing and corrected data generating means 3 can also be incorporated in the timing controller 1.

Embodiment 6.

Figure 15:
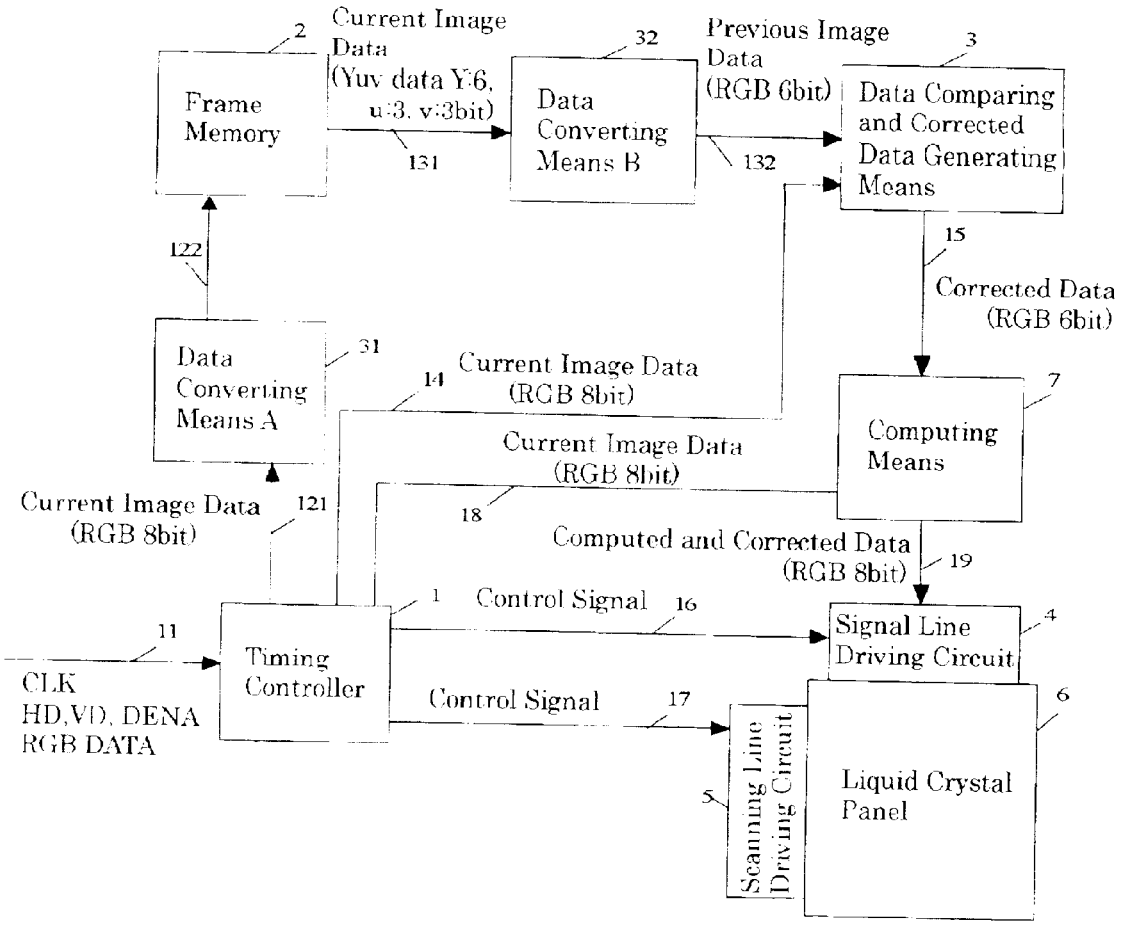
FIG. 15 is a block diagram of the liquid crystal display device of the sixth embodiment of the present invention.
Figure 16:
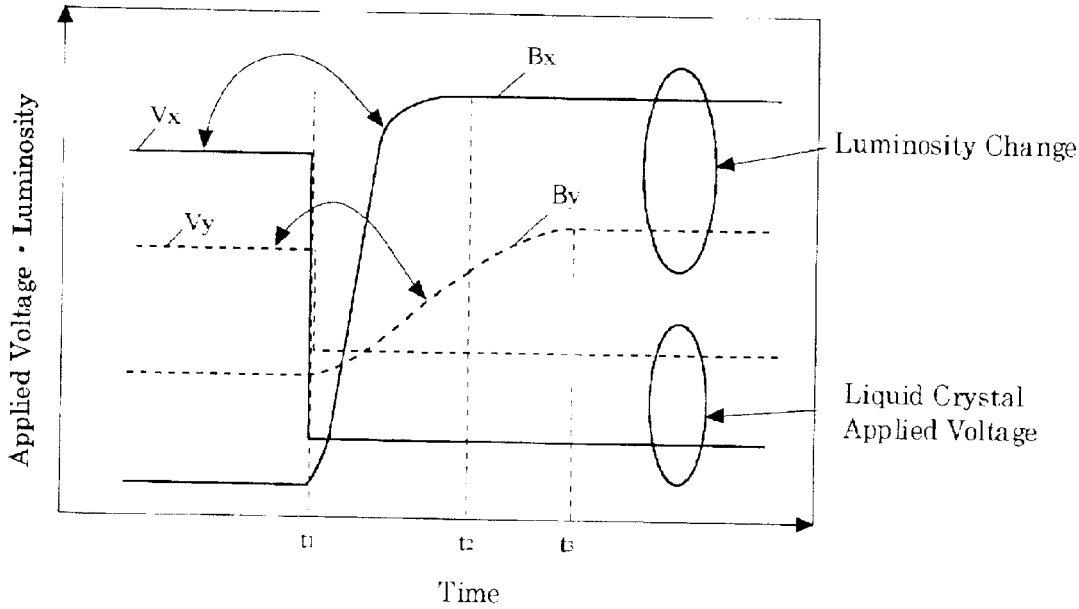
FIG. 16 shows a schematic diagram of the relationship between the liquid crystal applied voltage and liquid crystal response.
Figure 17:
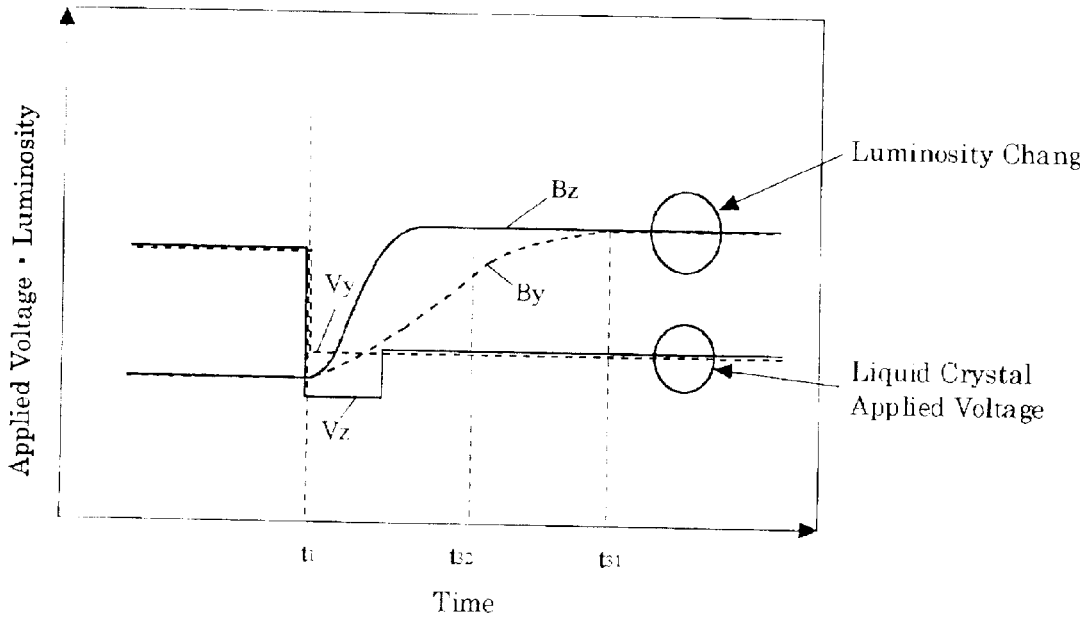
FIG. 17 is a schematic diagram of the relationship between the liquid crystal applied voltage and the liquid crystal response.

FIG. 15 shows a block diagram relating to signal processing in a liquid crystal display device relating to a sixth embodiment of the present invention. In this sixth embodiment, in particular, in the liquid crystal display device described in the second embodiment, the RGB data is converted to Yuv data for storage in the frame memory 2, and corrected data is then generated by converting the storing Yuv data to RGB data and comparing this data with the current image data.

As shown in FIG. 15, current image data 121 comprising respective 8-bit RGB data output by the timing controller 1 is input to data converting means A31. The data converting means A31 then converts the respective RGB 8-bit current image data 121 thus input to Yuv, and outputs 12-bit Yuv data 122. The current image data 122 output by the data converting means A31 is stored in the frame memory 2. It is then read out at a prescribed timing, and output as previous image data 131. This previous image data 131 is 12-bit Yuv data. The previous image data 131 is input to data converting means B32, and converted back to respective 6-bit RGB data. In the data comparing and corrected data generating means 3, the previous image data converted to RGB data is compared with the respective 8-bit RGB data of the current image data, to generate respective 6-bit RGB corrected data 15, which is output to the computing means 7. Computing means 7 then performs calculation as described in the second embodiment, using the respective 8-bit RGB current image data 18, and the respective 6-bit RGB corrected data 15, and it outputs respective 8-bit RGB corrected data 19 to the signal line driving circuit 4.

In this way, the frame memory 2 stores 12-bit Yuv data which has been converted by the data converting means A31, and hence the capacity required in the frame memory in order to generate corrected data is 1024×768×12=9 Mbit, which allows the memory capacity to be reduced compared to the prior art. Moreover, the number of bus lines between the data converting means A31 and the frame memory 2 can also be reduced to 12 lines. This description related to an example where the data was converted to 12-bit Yuv data, but the invention is not limited to this, and provided that the data is converted to data of 23 bits or fewer, it will be possible to reduce the memory capacity of the frame memory 2, and the number of bus lines between the data converting means A31 and the frame memory 2, thereby achieving the beneficial effects of the present invention.

In the data converting means B32, when converting the 12-bit Yuv data to RGB data, it is possible to use an algorithm to convert respective 4-bit RGB data to RGB data of any number of bits up to 8 bits. For example, if converting to respective 6-bit RGB data, the memory capacity of the related look-up table can be reduced to 3×64×256×8=384 Kbit. Moreover, the respective bit numbers for the RGB elements do not have to be the same, and mutually different bit numbers can be used for the R, G, and B elements.

This description related to the reduction of the memory capacity required for a look-up table in a case where the data is converted to respective 6-bit RGB data, but the invention is not limited to this, and the beneficial effects of the present invention can still be achieved provided that the RGB data is converted to data of 23 bits or fewer.

The data converting means A31, data converting means B32 and data comparing and corrected data generating means 3 can also be incorporated in the timing controller 1.

Embodiment 7.

In the liquid crystal display device described in the third embodiment, it is possible to convert the RGB data to Yuv data for storage in the frame memory 2, and then to generate corrected data by converted the stored Yuv data to RGB data and comparing this data with the current image data. In this case also, it is possible to achieve respective reductions in the memory capacity of the frame memory 2, the number of bus lines between the data converting means A31 and the frame memory 2, the number of bus lines between the data converting means B32 and the data comparing and corrected data generating means 3, and the memory capacity of the look-up table.

Other Embodiments.

In the foregoing examples, the current image data and the image data for the immediately preceding frame were compared to generate corrected data, but the invention is not limited to this, and it is also possible to create corrected data by comparing the immediately preceding image data with past image data, such as the image data for the immediately preceding frame and the image data preceding that, or the like. Thereby, image quality can be further enhanced.

Moreover, the foregoing examples related to a TFT type liquid crystal panel, but the invention is not limited to this, and there are no restrictions on the type of liquid crystal used, for instance, a passive-type liquid crystal panel may also be used.

In the aforementioned fifth, sixth and seventh embodiments, the RGB data was converted to Yuv data by data converting means A, and was then subsequently reconverted to RGB data by the data converting means B, but the invention is not limited to this, and it is also possible to generate corrected data on the basis of the Yuv data. However, in this case, it would be necessary to convert the corrected data to RGB data.

In the aforementioned embodiment, there is provided a liquid crystal display device for implementing a liquid crystal display by inputting image data for achieving a gray shade display, comprising: image data inputting means for inputting image data, image data memory for storing image data comprising a number of bits which is fewer than the number of bits in the image data input to the image data inputting means, on the basis of this image data, corrected data generating means for generating corrected data by correcting the current image data input to the image data inputting means, on the basis of previous image data stored in the image data memory, and liquid crystal driving means for inputting the corrected data and driving liquid crystals. Consequently, the liquid crystal display device enables the capacity of image data memory storing previous image data to be reduced, thereby yielding a merit in that cost savings can be achieved. Moreover, since the number of bus lines between the image data input means and the image data memory can be reduced, it is possible to reduce the scale of the circuit board on which these devices are mounted, whilst also increasing freedom of design.

Also, there is provided a liquid crystal display device, wherein the image data memory stores image data comprising a number of bits that is fewer than the number of bits in the image data input to the image data inputting means, by extracting the most significant bits of the image data input to the image data inputting means. Consequently, this liquid crystal display device yields a merit in that the number of bits to be stored can be further reduced, without involving a more complicated structure.

Moreover, there is provided a liquid crystal display device, wherein the corrected data generating means comprises a reference table which associates previous image data, current image data and corrected data, and generates corrected data by using the reference table. Consequently, this liquid crystal display device, in particular, enables the memory capacity of a reference table to be reduced, thereby achieving cost savings.

Furthermore, there is provided a liquid crystal display device, wherein the number of bits of image data stored in the image data memory is set on the basis of the gray scale data and the display luminosity characteristics of the liquid crystal display device. Consequently, the liquid crystal display device, in particular, allows the number of bits to be set with regard to the characteristics of the luminosity resolving ability of the human eye, namely, the fact that the luminosity resolving ability of the human eye is low when the change in luminosity is small, whilst the luminosity resolving ability of the human eye is high when the change in luminosity is large, and hence it enables memory capacity to be reduced without causing image quality to decline.

There is provided a liquid crystal display device, wherein the reference table provided in the corrected data generating means is set on the basis of the gray scale data and display luminosity characteristics of the liquid crystal display device. Consequently, the liquid crystal display device, in particular, enables the memory capacity of a reference table to be reduced, without causing image quality to decline.

There is provided a liquid crystal display device, wherein the corrected data generating means generates corrected data having the same number of bits as the image data stored in the image data memory, and the liquid crystal display device further comprises computing means for generating corrected data having the same number of bits as the current image data, on the basis of the corrected data generated by the corrected data generating means, and the whole of, or a portion of, the current image data, and outputting the corrected data to the liquid crystal driving means. Accordingly, the liquid crystal display device, in particular, enables the number of processing bits in the corrected data generating means to be reduced.

There is provided a liquid crystal display device, wherein the corrected data generating means generates corrected data by inputting most significant bits of the current image data comprising a number of most significant bits that is fewer that the number of bits for gray shade display and equal to or greater than the number of bits of image data stored in the image data memory. Consequently, this liquid crystal display device, in particular, enables the number of processing bits in the corrected data generating means to be reduced.

There is provide a liquid crystal display device, wherein the computing means generates the corrected data by inputting least significant bits of the current image data comprising a number of least significant bits equal to the number of bits of current image data input to the image data inputting means minus the number of bits of corrected data generated by the corrected data generating means. Accordingly, the liquid crystal display device enables the number of processing bits in the computing means to be reduced.

Furthermore, there is provided a liquid crystal display device, further comprising, first data converting means for converting image data consisting of RGB data into Yuv data, and second data converting means for converting Yuv data into RGB data, wherein the first data converting means converts the image data input to the image data inputting means, into Yuv data, and outputs same to the image data memory, the image data memory stores the Yuv data converted by the first data converting means and the second data converting means outputs the Yuv data stored in the image data memory to the corrected data generating means, as previous image data. Accordingly, the liquid crystal display device according to the ninth aspect of the present invention enables the beneficial effects of the first aspect of the invention to be achieved, by means of a different mode of implementation to the first aspect of the invention.

While preferred embodiments of the invention have been described using specific terms, such description is for illustrative purposes only, and it is to be understood that changes and variations may be made without departing from the spirit of scope of the following claims.

What is claimed is:

1. A liquid crystal display device for implementing a liquid crystal display by inputting image data for achieving a gray shade display, comprising:

image data inputting means for inputting image data;

image data memory for storing image data comprising a number of bits which is fewer than the number of bits in the image data input to said image data inputting means, on the basis of this image data;

corrected data generating means for generating corrected data by correcting the current image data input to said image data inputting means, on the basis of previous image data stored in said image data memory; and liquid crystal driving means for inputting said corrected data and driving liquid crystals;

wherein a number of bits of image data stored in the image data memory is set based on a γ value of the liquid crystal display.

2. The liquid crystal display device in accordance with claim 1, further comprising:

γ value changing means for changing the γ value; and control means for changing said number of bits of image data stored in said image data memory based on the γ value changed by the γ value changing means.

3. The liquid crystal display device in accordance with claim 2, wherein the control means increases the number of bits of image data stored in said image data memory when the γ value changed by γ value changing means is higher than a predetermined value.

4. The liquid crystal display device in accordance with claim 1, further comprising:

first data conversion means for converting the image data input to said image data inputting means to image data, that correspond to a γ value lower than a predetermined value, when the γ value changed by γ value changing means is higher than a predetermined value; and second data conversion means for converting the corrected data generated on the basis of the image data converted by the first conversion means to the image data input to the image data inputting means;

wherein the image data memory stores the image data as a number of bits set on the basis of the γ value lower than the predetermined value; and the corrected data generating means uses the image data, that comprise a number of bits corresponding to the γ value lower than the predetermined value, stored in the input image data memory as the previous image data, and generates the corrected data.

5. The liquid crystal display device in accordance with claim 1, wherein the corrected data generating means comprises a reference table that associates previous image data, current image data, and corrected data, and generates corrected data by using said reference table; and the liquid crystal display device further comprises γ value changing means for changing the γ value of the liquid crystal display, and the control means changes the reference table on the basis of the γ value changed by the γ value changing means.

6. A liquid crystal display device for implementing a liquid crystal display by inputting image data for achieving a gray shade display, comprising:

image data inputting means for inputting image data;

image data memory for storing image data comprising a number of bits which is fewer than the number of bits in the image data input to said image data inputting means, on the basis of this image data;

corrected data generating means for generating first corrected data having the same number of bits as the image data stored in said image data memory by correcting the current image data input to said image data inputting means, on the basis of previous image data stored in said image data memory;

computing means for generating second corrected data having the same number of bits as the current image data, on the basis of in whole or in part of the first corrected data and the current image data, and outputting the second corrected data; and liquid crystal driving means for inputting the second corrected data and driving liquid crystals.

7. The liquid crystal display device in accordance with claim 6, wherein said corrected data generating means generates corrected data by inputting most significant bits of the current image data comprising a number of most significant bits that is fewer that the number of bits for gray shade display and equal to or greater than the number of bits of image data stored in said image data memory.

8. The liquid crystal display device in accordance with claim 6, wherein said computing means generates said corrected data by inputting least significant bits of the current image data comprising a number of least significant bits equal to the number of bits of current image data input to said image data inputting means minus the number of bits of corrected data generated by said corrected data generating means.

9. The liquid crystal display device in accordance with claim 6, further comprising:

first data converting means for converting image data consisting of RGB data into Yuv data; and second data converting means for converting Yuv data into RGB data;

wherein said first data converting means converts the image data input to said image data inputting means, into Yuv data, and outputs same to said image data memory;

said image data memory stores the Yuv data converted by said first data converting means; and said second data converting means outputs the Yuv data stored in said image data memory to said corrected data generating means, as previous image data.

10. A drive circuit for a liquid crystal display device for implementing a liquid crystal display by inputting image data for achieving a gray shade display, comprising:

image data inputting means for inputting image data;

image data memory for storing image data comprising a number of bits that is fewer than the number of bits in the image data input to said image data inputting means, on the basis of this image data;

corrected data generating means for generating corrected data by correcting the current image data input to said image data inputting means, on the basis of previous image data stored in said image data memory; and liquid crystal driving means for inputting said corrected data and driving liquid crystals;

wherein the number of bits of image data stored in the image data memory is set on the basis of a γ value of the liquid crystal display.

11. The drive circuit in accordance with claim 10, further comprising:

γ value changing means for changing the γ value; and control means for changing said number of bits of image data stored in said image data memory based on the γ value changed by the γ value changing means.

12. The drive circuit in accordance with claim 11, wherein the control means increase the number of bits of image data stored in said image data memory when the γ value changed by γ value changing means is higher than a predetermined value.

13. The drive circuit in accordance with claim 10, further comprising:

first data conversion means for converting the image data input to said image data inputting means to image data, that correspond to a γ value lower than a predetermined value, when the γ value changed by γ value changing means is higher than a predetermined value; and second data conversion means for converting the corrected data generated on the basis of the image data converted by the first conversion means to the image data input to the image data inputting means;

wherein the image data memory stores the image data as a number of bits set on the basis of the γ value lower than the predetermined value; and the corrected data generating means uses the image data, that comprise a number of bits corresponding to the γ value lower than the predetermined value, stored in the input image data memory as the previous image data, and generates the corrected data.

14. The drive circuit in accordance with claim 10, wherein the corrected data generating means comprises a reference table that associates previous image data, current image data and corrected data, and generates corrected data by using said reference table; and the liquid crystal display device further comprises γ value changing means for changing the γ value of the liquid crystal display, and the control means changes the reference table on the basis of the γ value changed by the γ value changing means.

15. A drive circuit for a liquid crystal display device for implementing a liquid crystal display by inputting image data for achieving a gray shade display, comprising:

image data inputting means for inputting image data;

image data memory means for storing image data comprising a number of bits which is fewer than the number of bits in the image data input to said image data inputting means, on the basis of this image data;

corrected data generating means for generating first corrected data having the same number of bits as the image data stored in said image data memory by correcting the current image data input to said image data inputting means, on the basis of previous image data stored in said image data memory;

computing means for generating second corrected data having the same number of bits as the current image data, on the basis of in whole or in part of the first corrected data and the current image data, and outputting the second corrected data; and liquid crystal driving means for inputting the second corrected data and driving liquid crystals.

16. The drive circuit in accordance with claim 15, wherein said corrected data generating means generates corrected data by inputting most significant bits of the current image data comprising a number of most significant bits that is fewer that the number of bits for gray shade display and equal to or greater than the number of bits of image data stored in said image data memory.

17. The liquid crystal display device in accordance with claim 15, wherein said computing means generates said corrected data by inputting least significant bits of the current image data comprising a number of least significant bits equal to the number of bits of current image data input to said image data inputting means minus the number of bits of corrected data generated by said corrected data generating means.

18. The liquid crystal display device in accordance with claim 15, further comprising:

first data converting means for converting image data consisting of RGB data into Yuv data; and second data converting means for converting Yuv data into RGB data;

wherein said first data converting means converts the image data input to said image data inputting means, into Yuv data, and outputs same to said image data memory;

said image data memory stores the Yuv data converted by said first data converting means; and said second data converting means outputs the Yuv data stored in said image data memory to said corrected data generating means, as previous image data.

* * * * *